United States Patent [19]

Smith

[11] Patent Number: 4,658,965

[45] Date of Patent: Apr. 21, 1987

[54] DISC SCREEN CLASSIFIER

[75] Inventor: William C. Smith, West Vancouver, Canada

[73] Assignee: Beloit Corporation, Beloit, Wis.

[21] Appl. No.: 790,944

[22] Filed: Oct. 24, 1985

[51] Int. Cl.[4] ..... B07B 1/14

[52] U.S. Cl. ..... 209/672; 177/103; 209/933

[58] Field of Search ..... 209/546, 667, 670, 672, 209/361, 621, 933, 920, 593; 177/103, 104, 105, 65, 66

[56] References Cited

U.S. PATENT DOCUMENTS

| | | | |
|---|---|---|---|
| 2,343,042 | 2/1944 | Barry | 209/920 |
| 2,782,926 | 2/1957 | Saxe | 177/103 |
| 3,254,729 | 6/1966 | Behlen | 177/103 |
| 3,985,233 | 10/1976 | Sherman | 209/672 |
| 4,172,527 | 10/1979 | Bost | 209/670 |
| 4,377,474 | 3/1983 | Lindberg | 209/672 |
| 4,430,210 | 2/1984 | Tuuha | 209/672 |
| 4,588,091 | 5/1986 | Wade | 209/546 |

FOREIGN PATENT DOCUMENTS

| | | | |
|---|---|---|---|
| 1139677 | 7/1957 | France | 177/103 |
| 455307 | 10/1936 | United Kingdom | 209/670 |
| 2008001 | 5/1979 | United Kingdom | 209/672 |

*Primary Examiner*—Robert B. Reeves
*Assistant Examiner*—Donald T. Hajec
*Attorney, Agent, or Firm*—Dirk J. Veneman; Raymond W. Campbell; Gerald A. Mathews

[57] ABSTRACT

A point of sale wood chip classifier includes apparatus for receiving and discharging unclassified wood chips onto a longitudinally extending downwardly angled trough-shaped vibratory classification bed which includes a plurality of rotating disks for promoting tumbling of the chips toward an overflow end, the bed including openings between the disks defining a plurality of classification zones of increasing size along the bed in the downhill direction. A plurality of collection bins are located below the classification zones for receiving the classified chips, the classification bins being carried on respective load cells which signal the individual weights of a sample to a microcomputer for calculation of totality of chips and percentages of each classified component.

9 Claims, 5 Drawing Figures

10
12
14
16
18
20
22
24
25
26
28
29
30
32
34
35
36
38
40
42
44
46
48
50
52
54
56
58,62
60
64
66,70
68
72
74
76
78
80
82
II
III
V

DISC SCREEN CLASSIFIER

BACKGROUND OF THE INVENTION

1. Field of the Invention

The present invention relates to a disk screen classifier, and more particularly to a disk screen classifier for wood chips are classified with respect to the amount of sawdust, fines and oversized material.

2. Description of the Prior Art

Traditionally, the amount of sawdust, fines and oversized material in a batch of wood chips are sampled for each truck load or car load of wood chips at the point of purchase for pulp mills. The sampling and classification provides a quality index which is used as a basis for payment to the wood chip suppliers. A conventional classifier is known in the industry as the Williams Classifier which is a multi-deck shaker screen arrangement having round holes in various screen decks with larger holes at the top and progressively smaller holes at each stage down to the bottom. The sample taken from each truck load or car load is dropped onto the top deck while the screen is operating and the various size particles are segregated and retained on the various screen decks. The classifiers run for approximately 10 minutes, then dismantled and each tray is lifted out of its frame and dumped so that the material on each tray can be weighed. The size fractions are then all expressed as percentages of the total. As will be appreciated, this classification technique is a very laborious and tedious job in that the trays are very heavy and awkward to handle. The industry has therefore been seeking a better method and apparatus for classification of wood chips.

A chip thickness screening program, well known in the art, has developed a disk screen for screening chips according to thickness. This concept is rapidly becoming the new standard in the industry in that it is the thickness of a chip which determines liquor penetration and delignification. With such thickness screens, one may now screen out the overthick material and process the same through chip slicers in that there should be no material fed into a digester which is too thick to be properly pulped. Typical of this type of equipment is the disk screen of U.S. Pat. No. 4,301,930, issued Nov. 24, 1981 and fully incorporated herein by this reference.

During the industry evaluation of the effects of thickness screening, several types of shaker type classifiers were developed which supposedly classified chips according to thickness. Instead of round holes in the various screen decks, the decks were made by spaced steel rods providing gaps therebetween as the desired slot width. These screen decks were initially considered desirable, but they still have the disadvantages of the Williams type classifier. The trays are very heavy and the screen must be dismantled at the end of each classification run and the material picked out of the slots between the rods. Testing of this type of classifier provided and insight to all of the problems which users in the industry found undesirable, such as:

1. The sample which can be classified is very small, usually less than ½ cu. ft., or less than 10 lbs. This sample is too small to be representative of the totality of material in an entire railcar or a whole truck bed.

2. The sampling time was long and very laborious. The shaker screen was usually operated for 10 minutes and then dismantled so that each tray could be cleaned and the chips retained on that tray weighed. Generally, the time for classification of ½ cu. ft. of material was about 30 minutes.

3. The efficiency of these slot screen classifiers varies between 70% and 90% and is completely inconsistent. Two chips which should pass through the slot of a given width will wedge in the slot and, therefore, be retained on the wrong screen. To use these slot screen classifiers as a device for rating the aforementioned disk screens with respect to screen efficiency, one had to handsort according to thickness almost all of the material on some of the screen decks.

4. The rods and the various screen decks tend to bend slightly during operation and, after a certain time, the slot widths in any screen deck increase or decrease by as much as 2 mm which also contributes to the inefficiency of such classifiers.

SUMMARY OF THE INVENTION

The object of the present invention, therefore, is to provide a new and improved classifier which is faster and more efficient than classifiers heretofore known. The above object is achieved, according to the present invention, by fulfilling the desirable features for a classifier which were found during the aforementioned test program utilizing the disk screen principle, these features including:

1. Samples of 2½ or 3 cu.ft. should be processed, these samples weighing as much as 50–60 lbs.

2. The disk screen classifier should be a substantial self-cleaning apparatus.

3. A short time interval should be sufficient for processing 50 lbs. of material, for example an interval of 3–5 minutes.

4. The screening or classification accuracy should be above 90%.

5. The classifier should lend itself to automation so that a truly useful device would be available to the industry.

BRIEF DESCRIPTION OF THE DRAWINGS

Other objects, features and advantages of the invention, its organization, construction and operation will be best understood from the following detailed description, taken in conjunction with the accompanying drawings, on which.

DESCRIPTION OF THE PREFERRED EMBODIMENTS

Before turning to the drawings, a short general description of the apparatus will be given.

The classifier disclosed herein utilizes six shafts each carrying a plurality of disks for defining classification openings. Of course, a different number of shafts may be employed. The six shafts and the disks define a V-shaped or U-shaped trough or classification screen. An infeed chute for unclassified material is provided at one end of the classification bed for loading both halves of the V or U equally. The classification bed extends at a slight angle down from horizontal from the feed end toward the opposite end in order to help promote a tumbling effect of the unclassified chips toward the distal end. The screen efficiency has proven to be well in excess of 90% and all of the other objectives set forth above have been met.

The classification zones, as will be evident from the following description, are defined by the disk spacings with the spacings increasing from zone-to-zone from the feed end toward the opposite, distal end. These zones range from 2 mm at the feed end to, for example, 10 mm at the distal end. The 2 mm efficiently removes the pins and fines from the sample and, as will be evident from FIG. 4, a further screening beneath this first classification zone may be employed for separating the sawdust from the pins.

Advantageously, the material feed may comprise a vibratory feed chute in communication with a hopper which receives the sample to be screened. Advantageously, the infeed hopper operates in conjunction with a vibrating feed chute to provide consistent efficiency at an optimum rate. With a classifier constructed in accordance with the present invention, one may load any size of sample into the hopper and meter the same across the classifier at a desired rate. This permits consistent classification.

The classified material falls into collection bins which are supported by respective load cells. The load cells generate respective signals representing the weight of each product of classification, which signals are fed to a microcomputer for totalizing and calculation of the various percentages. The load cells, carrying the respective classification bins are mounted on a pivotal support which may be unlatched and dumped to an output conveyor so that the system may be rapidly returned for the next classification.

Figures 1, 2:
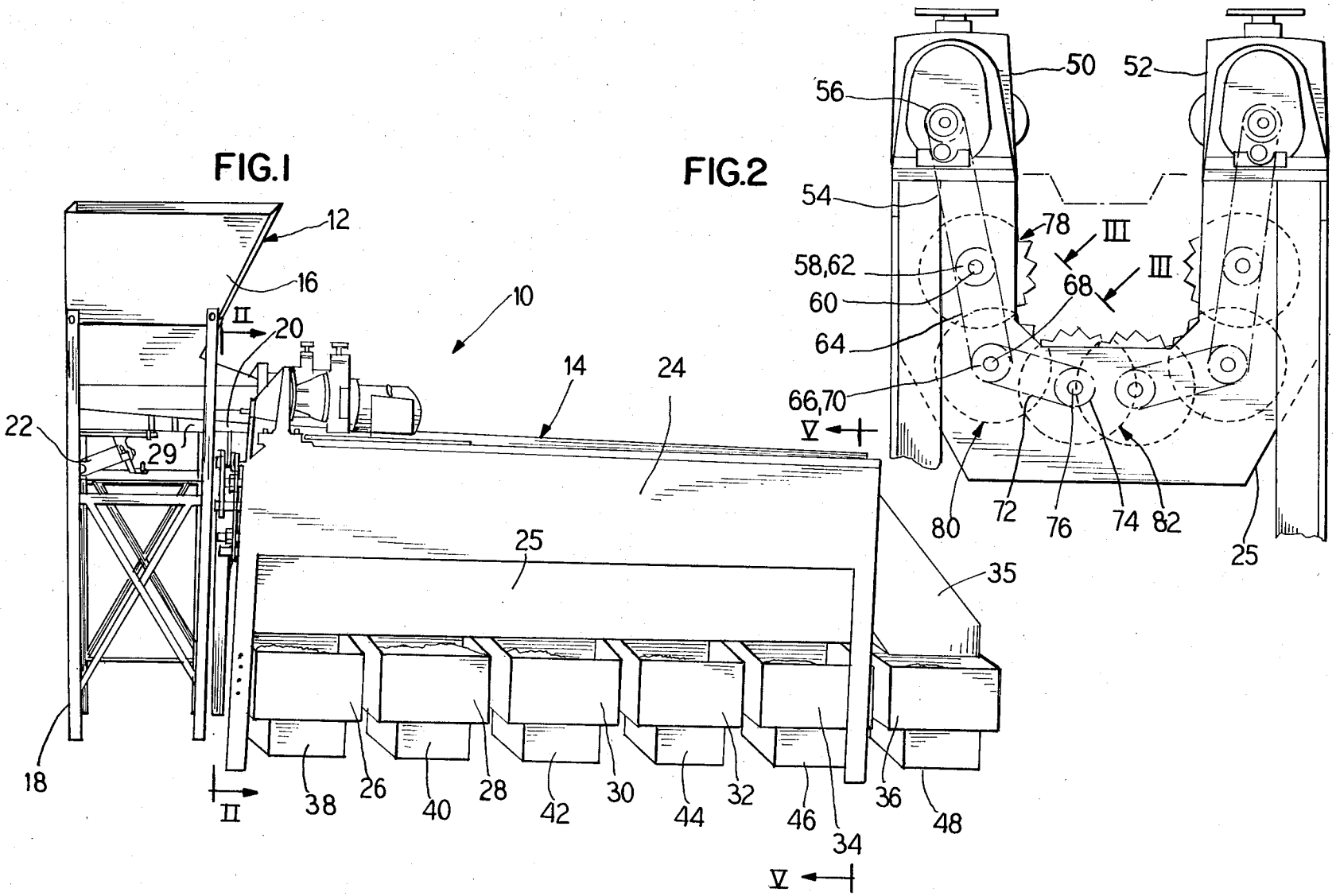
FIG. 1 is a side elevation of a disk screen classifier constructed in accordance with the present invention.
FIG. 2 is a view of the feed end of the classifier bed as viewed in the direction II—II of FIG. 1.

Turning to FIG. 1, a disk screen classifier is generally illustrated at 10 as comprising a feed device 12 and a classification bed 14.

The feed device 12 comprises a hopper 16 mounted on a frame 18 and in communication with a vibratory chute 20 driven by a vibrator 22. The output end of the chute 20 extends over a charging end of the classification bed 14.

The classification bed 14 comprises, in addition to end walls, a pair of longitudinal sidewalls 24 each having an inwardly directed portion 25 to direct the falling, classified material toward respective collection bins 26–34 carried on respective load cells 38–46. The distal end of the classification bed is provided with a discharge chute 35 for receiving an overflow of the largest material, which material is then received in a collection bin 36 mounted on a load cell 48.

Figure 3:
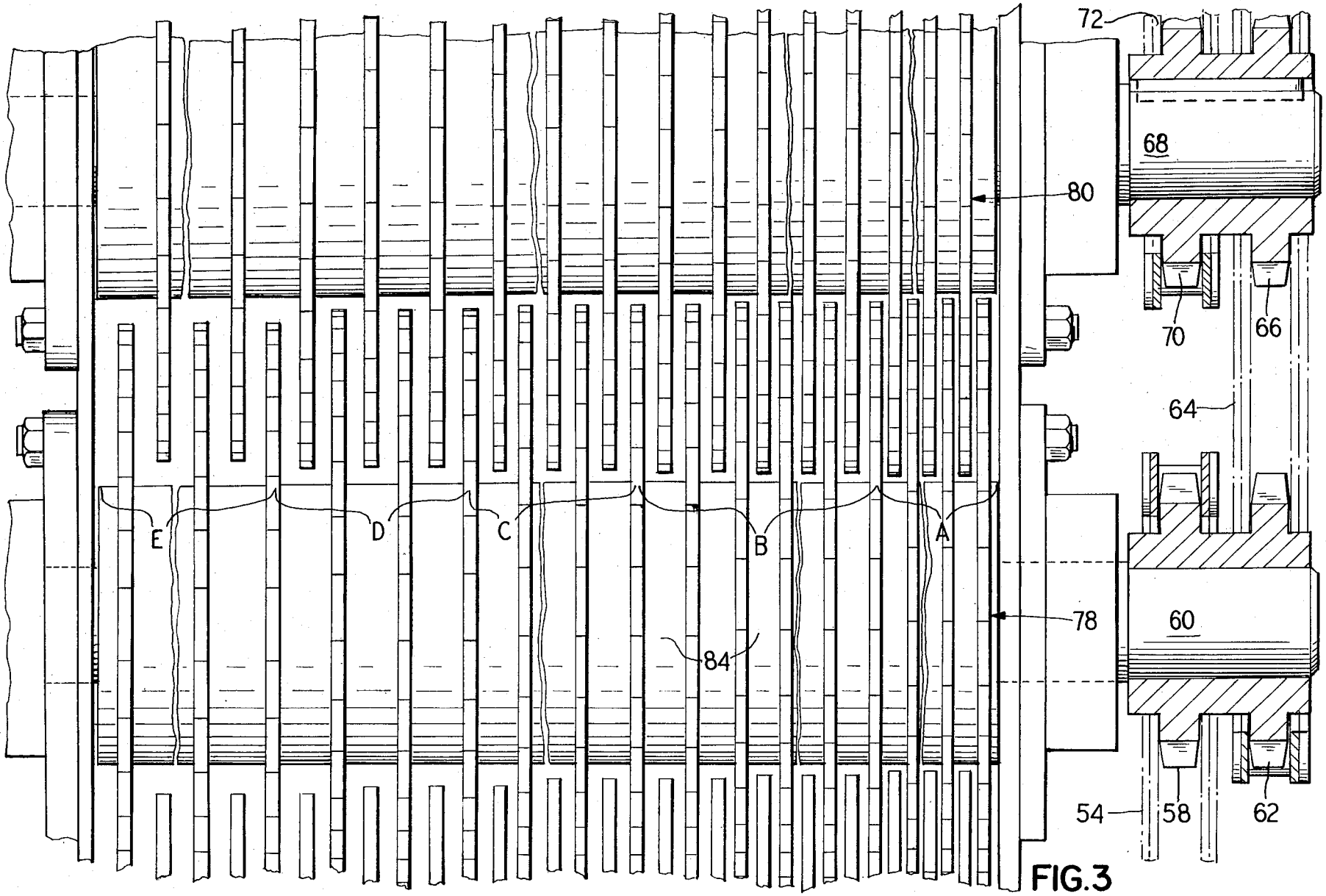
FIG. 3 is a top view of a portion of the classification bed of the classifier of FIG. 1.

Referring to FIGS. 2 and 3, the classification bed is illustrated as comprising a pair of drive motors 50, 52 mounted, as seen in FIG. 1, at the charging end of the classification bed. As illustrated for the drive motor 50, and which is the same for the drive motor 52, the drive motor 50 is provided with a drive sprocket 56 which is connected by way of the drive chain 54 to a driven sprocket 58 mounted coaxially on a shaft 60 with a further sprocket 62. The further sprocket 62 is connected by way of a drive chain 64 to a driven sprocket 66 mounted on a shaft 68 coaxial with a further sprocket 70. The further sprocket 70 is connected by way of a drive chain 72 to a driven sprocket 74 carried on a shaft 76.

The shafts 60, 68 and 76 carry a plurality of toothed discs spaced therealong and in an interdigital relationship, as defined by the diameter of the disks, for example 7", and a plurality of spacers 84 of widths which increase from zone-to-zone. This is more clearly illustrated in FIG. 3.

Referring specifically to FIG. 3, the pluralities of disks 78 and 80 are illustrated in detail, FIG. 3 showing the spacing of the disks to define the classification zones A–E which are, for example, 2 mm, 4 mm, 6 mm, 8 mm and 10 mm, respectively. The teeth of the disk have dual functions.

First of all, the rotating teeth provide a vibrating bed and promote a tumbling action of the unclassified material as it is urged to move downhill from the charging end towards the distal or overflow end. Secondly, the teeth provide a self-cleaning action for the openings formed between the entered digitally-associated disks.

Figure 4:
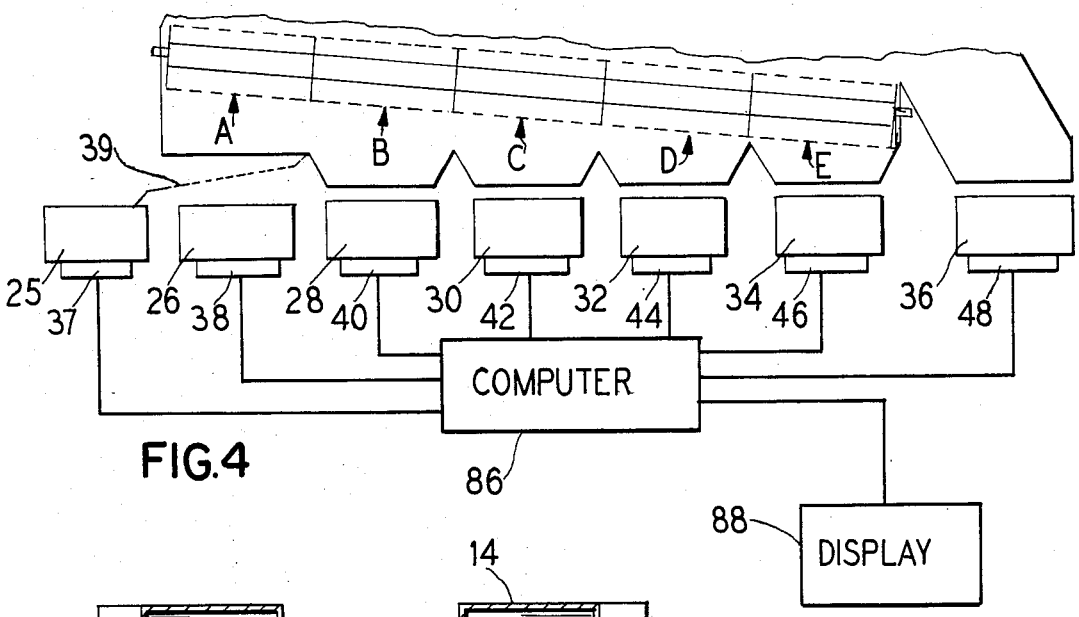
FIG. 4 is a fragmentary side elevation more specifically showing the apparatus for collecting and weighing the classified material.

Turning to FIG. 4, the bottom portion of the apparatus of FIG. 1 is illustrated in connection with weight measurement apparatus. As is apparent, each of the load cells 38–48 are connected to be representative weight signals to a computer 86 for totalization and computation of the various fractional portions of the sample. The computer is then connected to a display 88 for displaying the total and the various fractional samples in terms of percentage and/or weight. In addition to the apparatus illustrated in FIG. 1, a further classification screen 39 is provided below the first classification zone A for separating the pins into a collection bin 25 supported on a load cell 37 from the sawdust which passes through the screen 39 and is collected in the collection bin 26 carried on the load cell 38.

Figure 5:
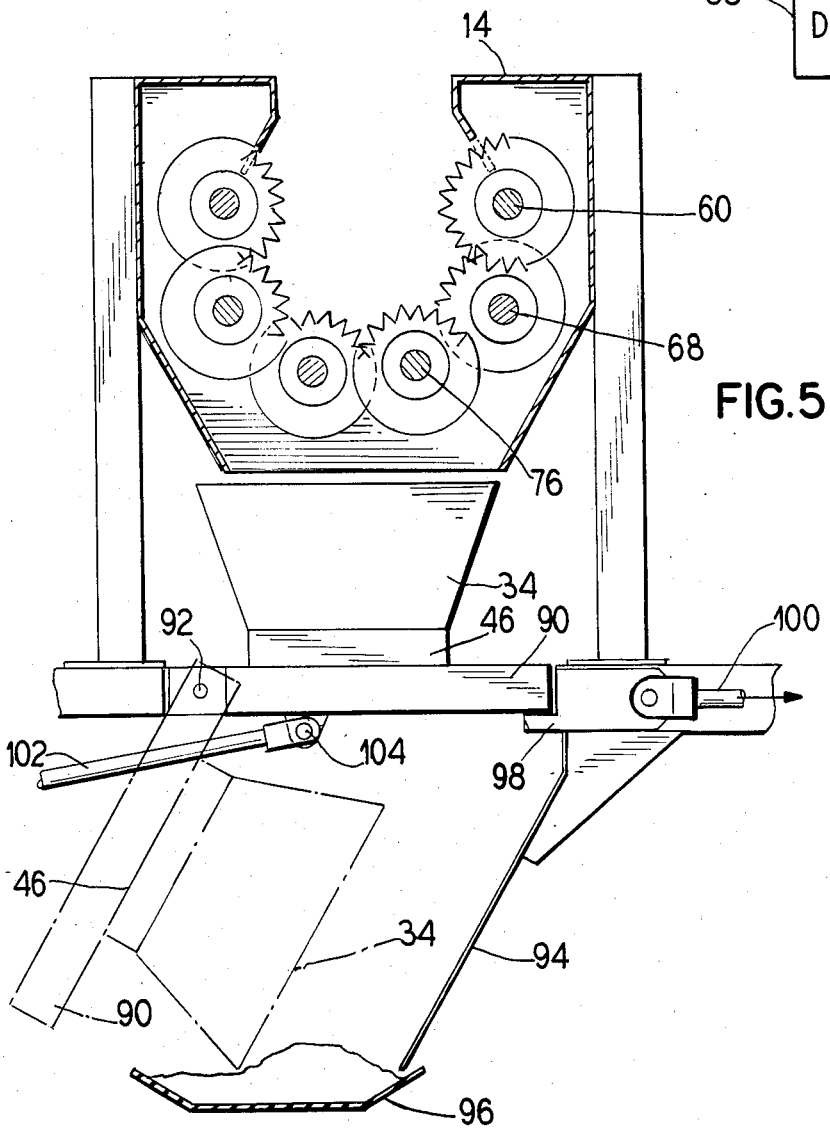
FIG. 5 is a sectional view, taken substantially along the line V—V showing the structure for dumping and carrying off the classified and weighed materials.

Referring to FIG. 5, the load cell support and the apparatus for conveying off the classified material is illustrated. As shown, the load cell 46, as with the other load cells, is carried on a support 90 which is pivotally mounted at 92 for pivoting to a dump position. While the material is being dumped, a deflector 94 is provided for guiding the material to an output conveyor 96. In the classification and weighing position, the support 90 is latched by way of a support lip 98 which is movable to an unlatched position by way of a shaft 100 which may be connected to a manually-operated lever, hydraulic or pneumatic ram or the like.

By the same token and in somewhat the same manner, the apparatus may be pivoted for dumping by way of a shaft 102 pivotally connected at 104 to the support 90, the shaft 102 again being operated by a manually operated lever, ram or the like.

In summary, a chip classifier constructed in accordance with the present invention meets all of the objects set forth above and provides, in particular:

1. A very accurate chip classification for separating a sample of chips according to the thickness, in which a selection of the number and spacing of the modules defining the zones can provide a classification into any desired fractions of any specified thickness.

2. A classifier constructed in accordance with the present invention can handle large quantities of material very quickly and, therefore, minimize sampling error.

3. A classifier constructed in accordance with the present invention is basically a self-cleaning device and the few chips that remain in the screen after a primary sample has been classified is so small that it will not effect classification results.

4. Inasmuch as the screen does not require dismantling, manpower has been minimized and tedious work has been eliminated. It should be pointed out here that most pulp mills have two people working two shifts doing classification work with the present classifiers. With a classifier constructed in accordance with the present invention, it will be possible for automatic sampling and classification at the chip purchasing stations utilizing a microcomputer so that the classification operation may now be done by an operator at the chip receiving facility so that other personnel will not be required.

5. A classifier constructed in accordance with the present invention will also be able to provide continuous sampling and classification for analyzing chips being produced in woodroom chippers. Changing of knives could be done when fines or sawdust percentage has reached a specified level.

6. Presently, pulp mills are completely automated and computer controlled, but do not have an input to the computer for average chip thickness. The present invention, automated as outlined above, will provide this information.

Although I have described my invention by reference to particular illustrative embodiments thereof, many changes and modifications of the invention may become apparent to those skilled in the art without departing from the spirit and scope of the invention. I therefore intend to include within the patent warranted hereon all such changes and modifications as may reasonably and properly be included within the scope of my contribution to the art.

I claim:

1. Wood chip classification apparatus comprising:

frame means including a classification bin, said bin including a first end and a second end;

feed means mounted at said first end of said classification bin for feeding wood chips into said classification bin;

a plurality of shafts rotationally mounted on said frame means in said classification bin with their axes of rotation parallel to one another and at an acute angle down with respect to horizontal from said first end to said second end;

a plurality of spaced apart disks on each of said shafts with said disks of adjacent shafts disposed in an interdigital relationship, the spacing of said disks defining a plurality of classification zones with increasing spacing from one zone to the next from said first end to said second end;

drive means mounted on said frame and connected to rotate said shafts whereby wood chips tumble from said first end towards said second end and are classified through said spaced disks in the respective classification zones; and collection means including a plurality of collection bins each located beolow a respective, weighing means including a plurality of load cells each supporting a respective collection bin and operable to generate an electrical signal representing chip weight;

conveying means below said collection bins; and dumping means carrying said load cells and said collection bins and operable to empty the contents of said collection bins onto said conveying means.

2. The wood chip classification apparatus of claim 1, wherein:

said feed means comprises a hopper for receiving wood chips and a vibratory chute extending from said hopper over said first end of said classification bin.

3. The wood chip classification apparatus of claim 1, wherein:

each of said disks comprises peripheral teeth for promoting tumbling of the wood chips.

4. The wood chip classification apparatus of claim 1, wherein:

said plurality of shafts and said plurality of disks on each of said shafts, define a trough.

5. The wood chip classification apparatus of claim 1, wherein said drive means comprises:

first and second drive motors mounted on said frame and each carrying a drive sprocket;

a plurality of driven sprockets mounted on said first ends of said shafts; and drive chains coupling the drive sprockets to the driven sprockets such that said first and second drive motors drive shafts on respective sides of said trough.

6. The wood chip classification apparatus of claim 1, and further comprising:

a further collection bin outside of said frame adjacent said second end wall for receiving wood chips too large for classification by said bed; and a further load cell on said support carrying said further collection bin.

7. Wood chip classification apparatus comprising: a vibratory classification bed including a first end, a second end lower than said first end, and tumbling means for vibrating and tumbling wood chips from said first end towards said second end, said tumbling means comprising a plurality of classification zones each including classification openings which increase in size from zone-to-zone towards said second end for passing and classifying the wood chips;

feed means mounted at said first end for feeding unclassified wood chips onto said classification bed; and collection means mounted below said classification bed; and including a respective collection bin for each of said zones, for collecting the classified wood chips, measuring means connected to each of said collection bins for weighing the contents thereof, a pivotally-mounted frame supporting said measuring means;

latch means for holding said frame in a position at which said collection bins receive the classified chips and operable to unlatch said frame and permit said bins to be pivoted towards an upside-down dumping position; and conveyor means for receiving and carrying the dumped classified wood chips.

8. The wood chips classification apparatus of claim 7, and further comprising:

a deflector mounted opposite the pivot of said frame and directed towards said conveyor means.

9. The wood chips classification apparatus of claim 7, wherein said tumbling means comprises:

a plurality of rotatable shafts extending parallel to one another;

a plurality of toothed disks carried spaced apart and interdigitally on said shafts to define the classification zones and classification openings; and drive means connected to rotate said shafts so that the wood chips are vibrated towards the center of said bed and towards said second end while being classified through said bed through respective classification openings.

* * * * *

UNITED STATES PATENT AND TRADEMARK OFFICE

CERTIFICATE OF CORRECTION

PATENT NO. 4,658,965

DATED April 21, 1987

INVENTOR(S) William C. Smith

It is certified that error appears in the above—identified patent and that said Letters Patent is hereby corrected as shown below:

Column 5, line 56 - Delete "beolow" and insert therefor "below".

Signed and Sealed this

Eleventh Day of August, 1987

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,658,965

DATED : April 21, 1987

INVENTOR(S) : William C. Smith

It is certified that error appears in the above—identified patent and that said Letters Patent is hereby corrected as shown below:

Column 5, line 56 - Delete "beolow" and insert therefor "below".

Column 5, line 56 - Insert after "respective" the omitted word "zone".

Signed and Sealed this

Fifteenth Day of December, 1987

*Attest:*

DONALD J. QUIGG

*Attesting Officer*

*Commissioner of Patents and Trademarks*